US009859650B2

(12) United States Patent
Forell et al.

(10) Patent No.: US 9,859,650 B2
(45) Date of Patent: Jan. 2, 2018

(54) PLUG ELEMENT WITH LOCKING SEAL

(75) Inventors: Richard Forell, Lorsch (DE); Joachim Schneider, Einhausen (DE); Marcus Gimbel, Freystadt/Burggriesbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 50 days.

(21) Appl. No.: 13/638,498

(22) PCT Filed: Mar. 24, 2011

(86) PCT No.: PCT/EP2011/054546
§ 371 (c)(1),
(2), (4) Date: Sep. 28, 2012

(87) PCT Pub. No.: WO2011/120868
PCT Pub. Date: Oct. 6, 2011

(65) Prior Publication Data

US 2013/0029508 A1 Jan. 31, 2013

(30) Foreign Application Priority Data

Mar. 30, 2010 (DE) ..... 10 2010 013 446

(51) Int. Cl.
*H01R 13/62* (2006.01)
*H01R 13/629* (2006.01)
(Continued)

(52) U.S. Cl.
CPC ... *H01R 13/62911* (2013.01); *H01R 13/5202* (2013.01); *H01R 13/5219* (2013.01); *H01R 13/743* (2013.01)

(58) Field of Classification Search
CPC ..... H01R 13/62938; H01R 13/62955; H01R 13/639; H01R 13/62; H01R 13/641
(Continued)

(56) References Cited

U.S. PATENT DOCUMENTS 5,928,011 A 7/1999 Flask et al.
6,155,850 A * 12/2000 Martin et al. ..... 439/157
(Continued)

FOREIGN PATENT DOCUMENTS

EP 0722204 A2 7/1996
EP 1745528 A1 1/2007
(Continued)

OTHER PUBLICATIONS

International Search Report and Written Opinion issued by the European Patent Office, dated Jun. 9, 2011, for PCT/EP2011/054546; 10 pages.
(Continued)

*Primary Examiner* — Hien Vu
(74) *Attorney, Agent, or Firm* — Faegre Baker Daniels LLP

(57) ABSTRACT

The invention relates to a plug element (2, 2') of a plug connector (1) for a sealed electrical plug-and-socket connection extending through a hole (4) in a wall (5), having a protective housing (9, 9'), which comprises an inner chamber (46), which at least in places forms a mating plug receptacle (45) for a mating plug element (3) complementary to the plug element (2, 2'), having a locking device (11, 11'), which is actuatable from outside the protective housing (9) and may be moved from an unlocked position (T) into a locked position (R), the locking device (11, 11') extending at least in the locked position (R) into the inner chamber (46) and overlapping the mating plug receptacle (45) at least in places, and having at least one sealing element (18, 18') resting against the protective housing (9, 9') at least in a final plugged-together position of the plug connector (1), by means of which sealing element the mating plug receptacle (45) may be sealed relative to the external environment of the plug connector (1). In order to provide a sealed plug
(Continued)

connector (1) with the smallest possible dimensions, provision is made according to the invention for at least one sealing element (18, 18') to be arranged sealingly between the protective housing (9, 9') and the locking device (11, 11') at least in the locked position (R).

15 Claims, 11 Drawing Sheets

(51) Int. Cl.
*H01R 13/52* (2006.01)
*H01R 13/74* (2006.01)

(58) Field of Classification Search
USPC ..... 439/157, 347, 271, 372
See application file for complete search history.

(56) References Cited

U.S. PATENT DOCUMENTS 6,361,362 B1 * 3/2002 Kressmann et al. ..... 439/555
7,063,547 B2 * 6/2006 Toyoda et al. ..... 439/157
7,686,644 B2 * 3/2010 Chu ..... H01R 13/2442 439/271
7,704,086 B2 * 4/2010 Gimbel ..... H01R 13/5202 439/157

FOREIGN PATENT DOCUMENTS

EP 1811612 A1 7/2007
JP H10-172647 A 6/1998
JP H11-67350 A 3/1999
WO WO 2005/101583 A1 10/2005

OTHER PUBLICATIONS

Search Report issued by the German Patent & Trademark Office, dated Dec. 17, 2010, for Priority Application No. DE 102010013446.5; 4 pages.
English Translation of Decision of Rejection dated Jul. 7, 2015, related to Japanese Patent Application No. 2013-501763; 2 pages.

* cited by examiner

PLUG ELEMENT WITH LOCKING SEAL

The invention relates to a plug element of a plug connector for a sealed electrical plug-and-socket connection extending through a hole in a wall, having a protective housing, which comprises an inner chamber, which at least in places forms a mating plug receptacle for a mating plug element complementary to the plug element, having a locking device, which is actuatable from outside the protective housing and may be moved from an unlocked position into a locked position, the locking device extending at least in the locked position into the inner chamber and overlapping the mating plug receptacle at least in places, and having at least one sealing element resting against the protective housing at least in a final plugged-together position of the plug connector, by means of which sealing element the mating plug receptacle may be sealed relative to the external environment.

The invention further relates to a plug connector for an electrical plug-and-socket connection extending through a hole in a wall, having a plug element intended to be arranged on a first side of the wall and a mating plug element intended to be arranged on a second side of the wall.

Plug elements and plug connectors of the above-stated type are known. They are used for example in automobiles for plug-and-socket connections extending through holes in body sheets. Since the automobile bodies may be exposed to harmful environmental influences such as wet, dirt and corrosive media, sealing is provided both for the plug connectors relative to the vehicle body or the wall formed thereby and for the electrical contact elements within the plug connector relative to the external environment.

The locking device, also known as Connector Positioning Assurance (CPA), locks the plug connector in the final plugged-together position, by holding the plug element and the mating plug element together and/or securing them against undesired separation. Furthermore, the locking device may make it easier to bring together the plug element and the mating plug element, forces introduced into the plug connector on actuation of the locking device being helpful when it comes to overcoming the plug-in force.

A plug connector of the above type is known for example from European Patent EP 1 745 528 B1 belonging to the same applicant. In this plug connector locking aids fixed to the mating plug element in each case pass through an opening in the plug element, wherein in each case a sealing element annularly enclosing the opening sits sealingly between the mating plug element and the plug element, to prevent liquids from entering the mating plug receptacle.

In the known plug connector the space taken up by the sealing element between the plug element and the mating plug element disadvantageously leads to widening of a pass-through portion of the plug connector, which in the final plugged-together position is arranged in the hole. Consequently the hole is also widened by an amount needed to accommodate the seal. However, it is desirable to make such holes as small as possible, in order for example to weaken an automobile body as little as possible in the region of the hole. A further disadvantage consists in the fact that the sealing element cannot prevent penetration of liquids into the inner chamber of the protective housing. Thus liquid may collect in the protective housing.

The object of the present invention is consequently to provide a plug connector which is sealed as well as possible with the smallest possible external dimensions.

With the above-stated plug element this object is achieved according to the invention in that at least in the locked position at least one sealing element is arranged between the protective housing and the locking device. The sealing element sits sealingly between the protective housing and the locking device.

In the case of the above-stated plug connector the object is achieved by a plug element configured according to the invention.

The solution according to the invention has the advantage of saving on the space taken up in the prior art by the sealing element while retaining the same number of contact elements. Consequently the overall plug connector and thus also the hole may be smaller or narrower than in the case of a plug connector according to the prior art with the same contact complement. Instead of between the protective housing and the housing of the mating plug, the mating plug receptacle may be sealed against the external environment at the locking device without affecting the dimensions of plug receptacle, mating plug receptacle or pass-through portion.

The solution according to the invention may be supplemented as desired and further improved by the following further in each case per se advantageous embodiments.

For instance, according to a first further embodiment of a plug element according to the invention it is possible for the protective housing to comprise at least one opening to the inner chamber, the at least one sealing element being arranged in the region of the opening at least in the locked position. Thus harmful substances may be prevented from penetrating even in the region of the opening and as far as possible the entire inner chamber may be sealed against the external environment.

According to a further possible embodiment the at least one sealing element may lie around the circumference of a peripheral portion of the opening at least in the locked position. This embodiment has the advantage that the sealing element fitted into the opening may ensure reliable sealing of the entire inner chamber, without running the risk of slipping on transfer of the plug connector into the final plugged-together position.

Assembly and disassembly of a plug element according to the invention may be simplified according to a further possible embodiment in that at least in the locked position an actuating portion of the locking device is arranged so as to be accessible from outside the protective housing. The locking device may fulfil a dual function if provision is made for the actuating portion to close the opening.

Manufacture of a plug element according to the invention may be further simplified in that the at least one sealing element and a wall sealing element for sealing the plug connector relative to the wall and intended for arrangement between the protective housing or a pass-through or plug-in portion of the plug element and the wall may be formed in one piece.

Handling and assembly of a plug element according to the invention may be further simplified in that the locking device may be configured as a slider, which may be latched to the protective housing in a pre-assembly position and in the locked position.

Handling and assembly of a plug element according to the invention may be further simplified in that the at least one sealing element may be formed at least in places of resilient material injection-moulded onto the protective housing. Alternatively it is possible for the at least one sealing element to be formed at least in places of resilient material injection-moulded onto the locking device. These embodiments have the advantage that the sealing element may be connected captively to the protective housing or the locking device.

The sealing element may at least in places circumferentially enclose a spar of the locking device projecting through the opening. Like a seal fitted in the peripheral area of the opening, this embodiment simplifies simultaneous locking and sealing of the protective housing on reaching the locked position.

Manufacture of a plug element according to the invention may be simplified by forming at least one closing stopper on the locking device, which closing stopper projects at least in the locked position through a tool recess in a wall of the protective housing, a stopper sealing element being arranged between the stopper and the tool recess. By means of the tool recess, tools for producing the plug element may be actuated or ejected after completion of a manufacturing step. The locking device may fulfil an additional function over and above locking and possible closure of the opening, in that it serves to seal the tool recess passing through a wall of the protective housing. This additional function may be achieved particularly simply in that the tool recess is aligned with the opening for example in an actuation direction. Provision may in this respect be made for the closing stopper to be configured as a peg around the circumference of which the at least one stopper sealing element is injection moulded.

In the case of the above-stated plug connector the solution according to the invention may be further improved in that the plug connector may comprise at least two rows of contact receptacles, wherein a pass-through portion of the plug connector arranged in the hole in the final plugged-together position may have a width measured across the at least two rows of at most 13 mm. Thus the hole or a width of the hole matched to the pass-through portion may be as narrow as possible.

The invention is explained in greater detail below by way of example by means of a plurality of embodiments and with reference to the appended drawings. The embodiments merely represent possible configurations, in which individual features, as described above, may be provided mutually independently and omitted. In the description of the embodiments the same features and elements are provided with the same reference signs for simplicity's sake.

Figure 3A:
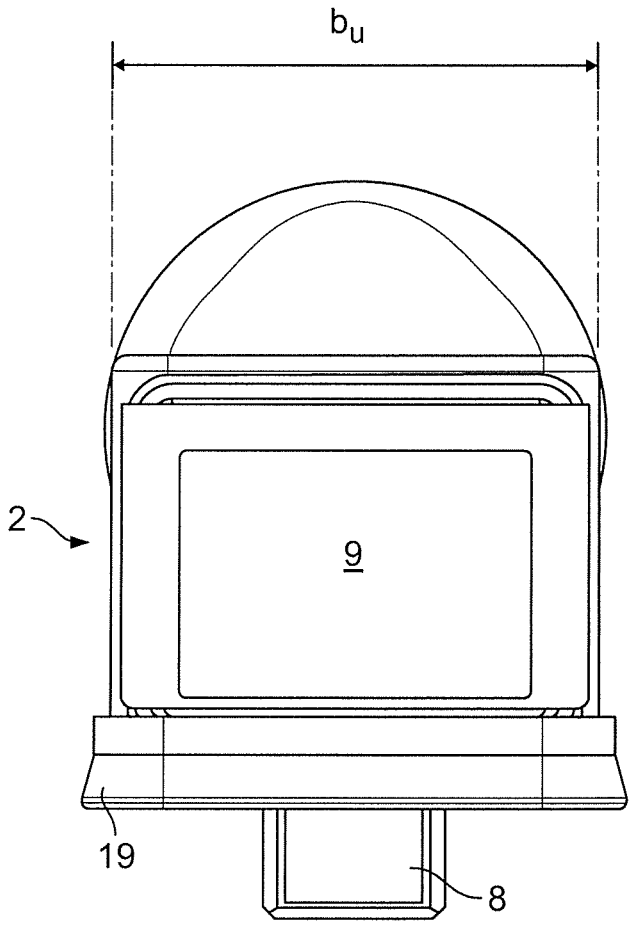
Figure 3B:
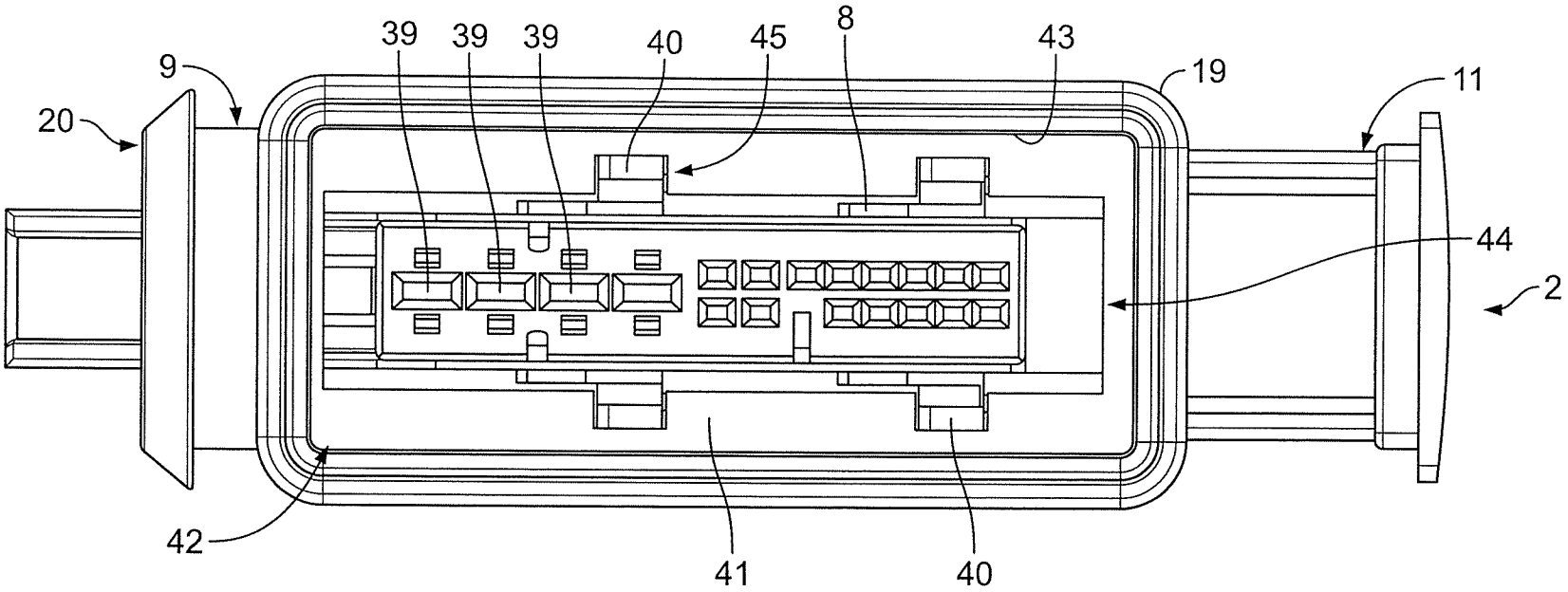

FIG. 3*a* shows a front view of a plug element according to the invention;

FIG. 3*b* shows a view from below of the plug element illustrated in FIG. 3*a;*

Figure 3C:
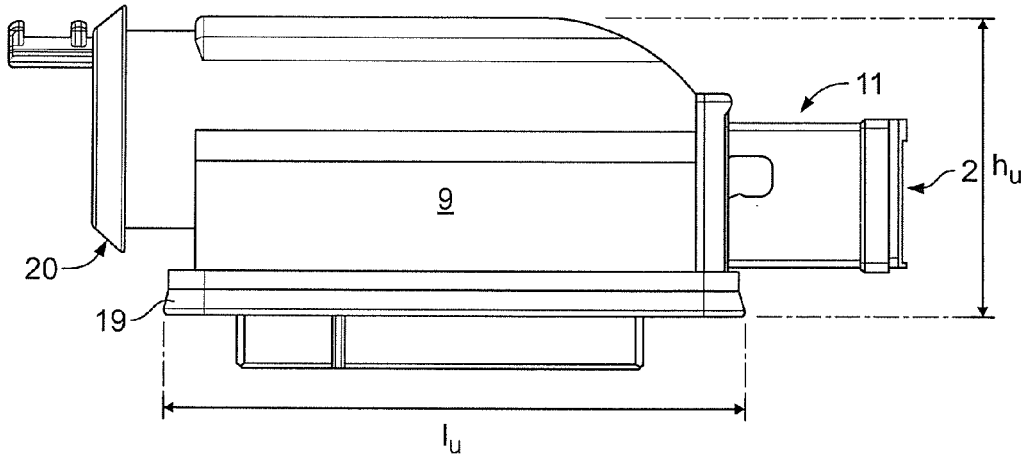

FIG. 3*c* shows a side view of the plug element shown in FIG. 3*a;*

Figure 3D:
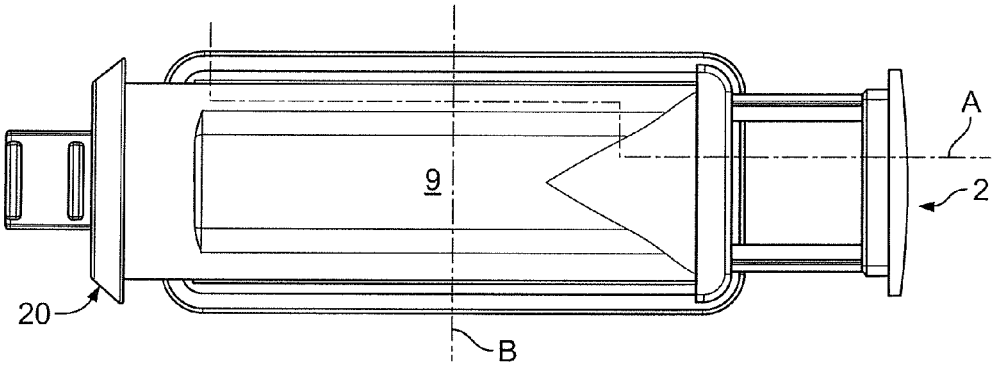

FIG. 3*d* shows a plan view of the plug element shown in FIG. 3*a;*

Figure 4:
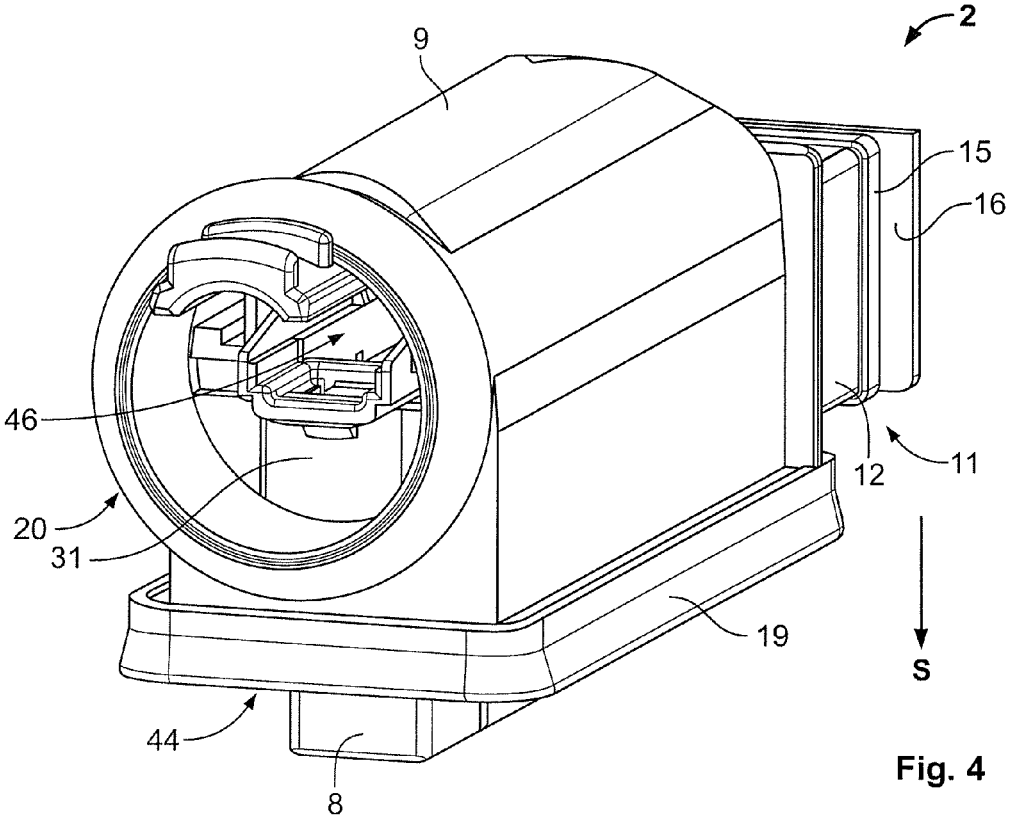
Figure 5:
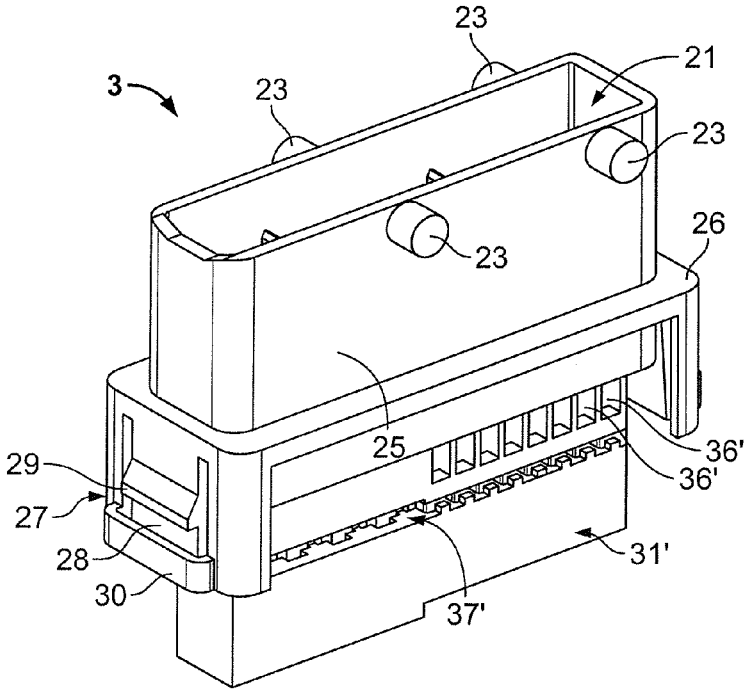
Figure 6:
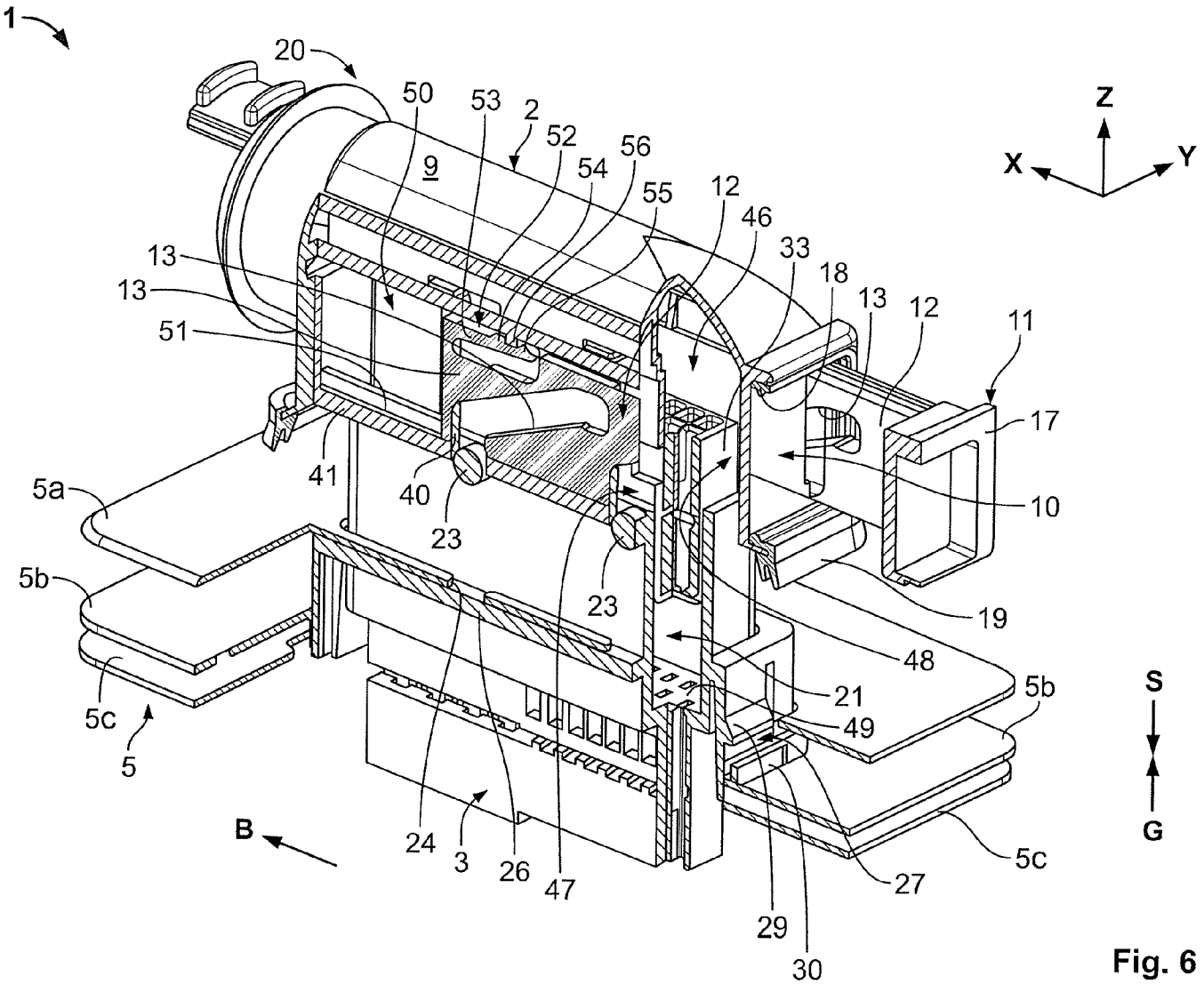

FIG. 4 shows a schematic perspective view of a plug element according to the invention in the assembled state;

FIG. 5 shows a schematic perspective view of a mating plug element according to the invention in a schematic perspective view;

FIG. 6 shows a schematic perspective view of a plug connector according to the invention in a semi-plugged-together position, said plug connector having been cut open along section line A shown in FIG. 3*d;*

Figure 7:
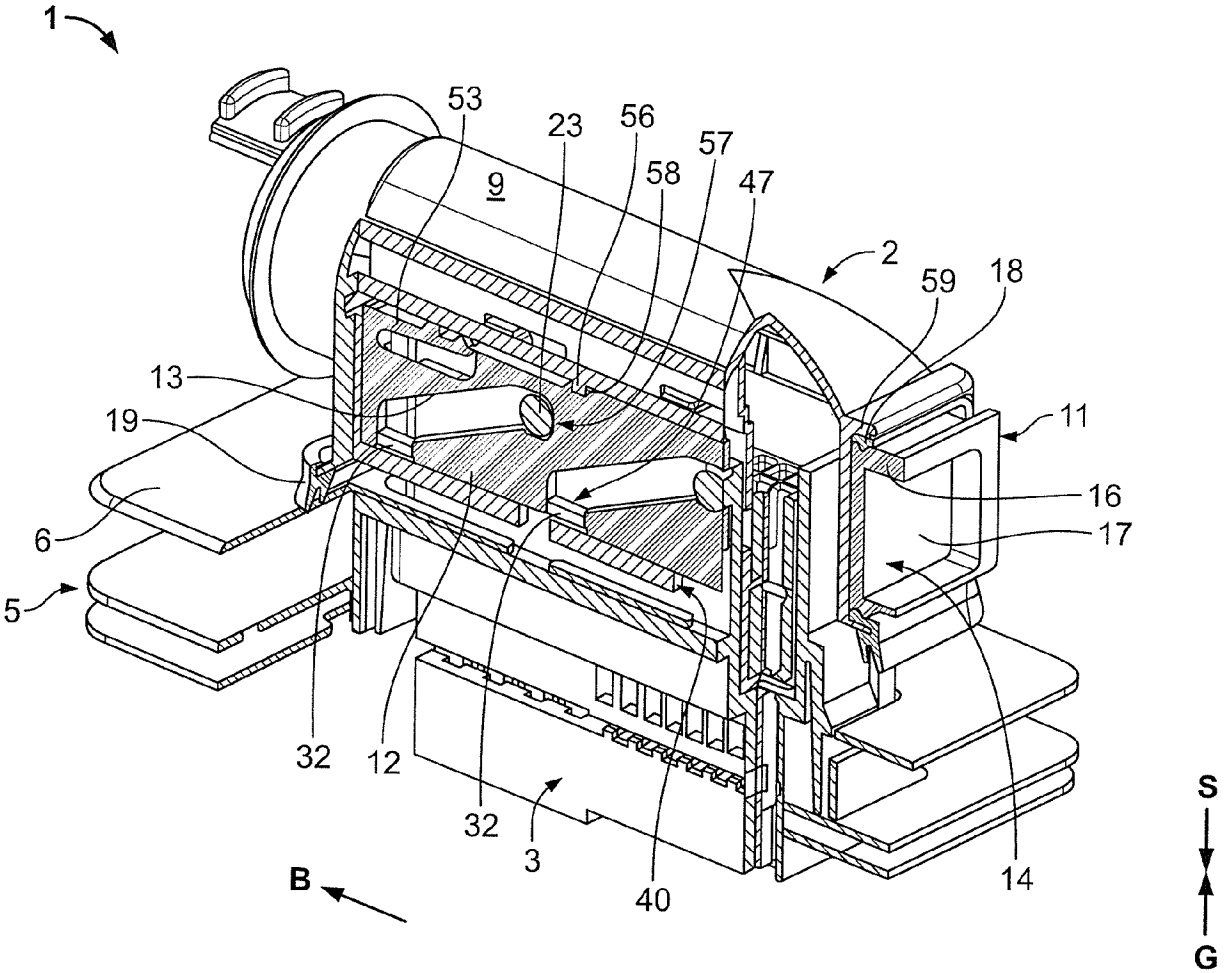

FIG. 7 shows a schematic perspective view of a plug connector according to the invention in a final plugged-together position, said plug connector having been cut open along section line A shown in FIG. 3*d;*

Figure 8:
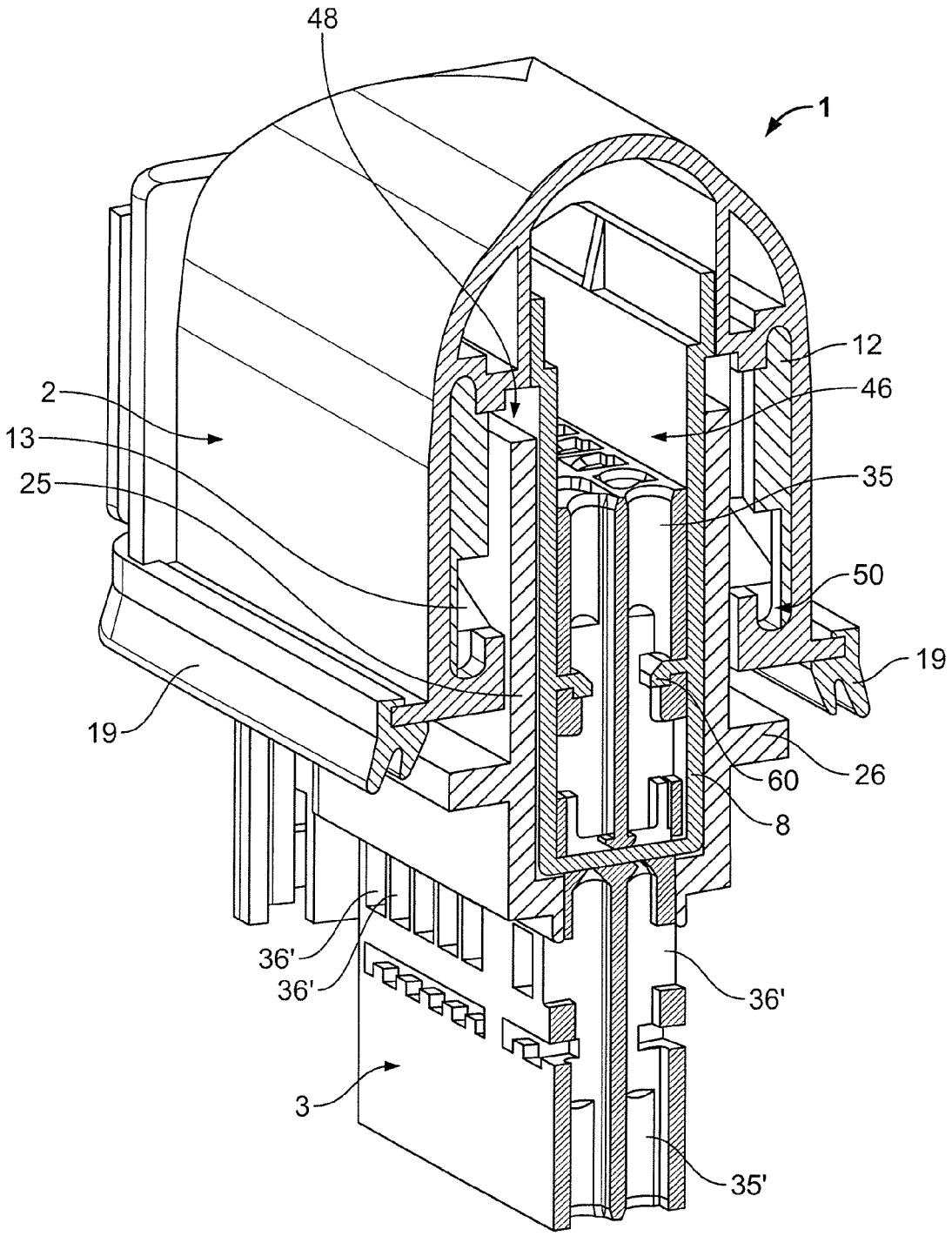

FIG. 8 shows a schematic perspective view of a plug connector according to the invention in the final plugged-together position, said plug connector having been cut open along section line B shown in FIG. 3*d;*

Figures 9A, 9B, 9C:
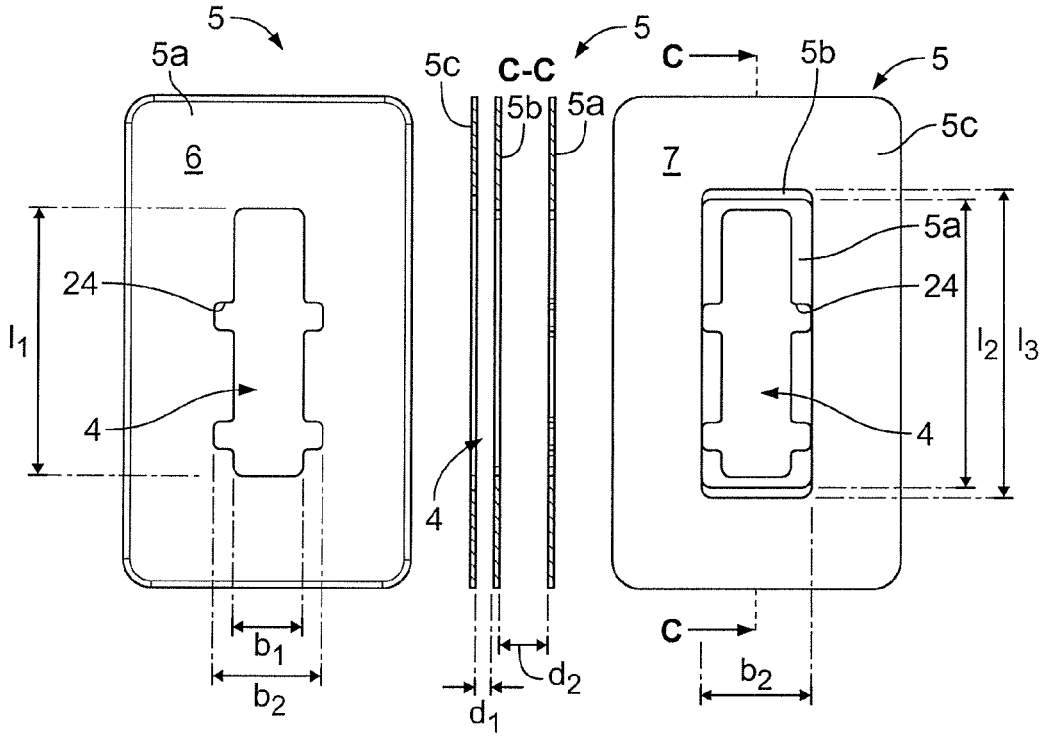

FIG. 9*a* shows a plan view of a wall and of a hole formed therein for passage of a plug connector according to the invention;

FIG. 9*b* shows a sectional view of the wall shown in FIG. 9*a* along section line C-C shown in FIG. 9*c;*

FIG. 9*c* shows a view from below of the wall illustrated in FIG. 9*a;*

Figure 10:
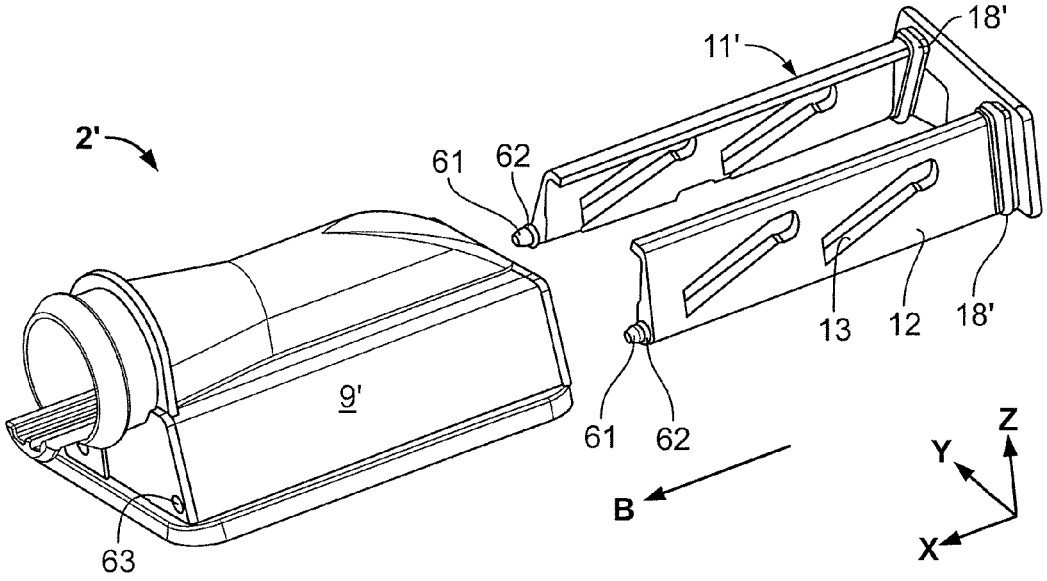
Figure 11:
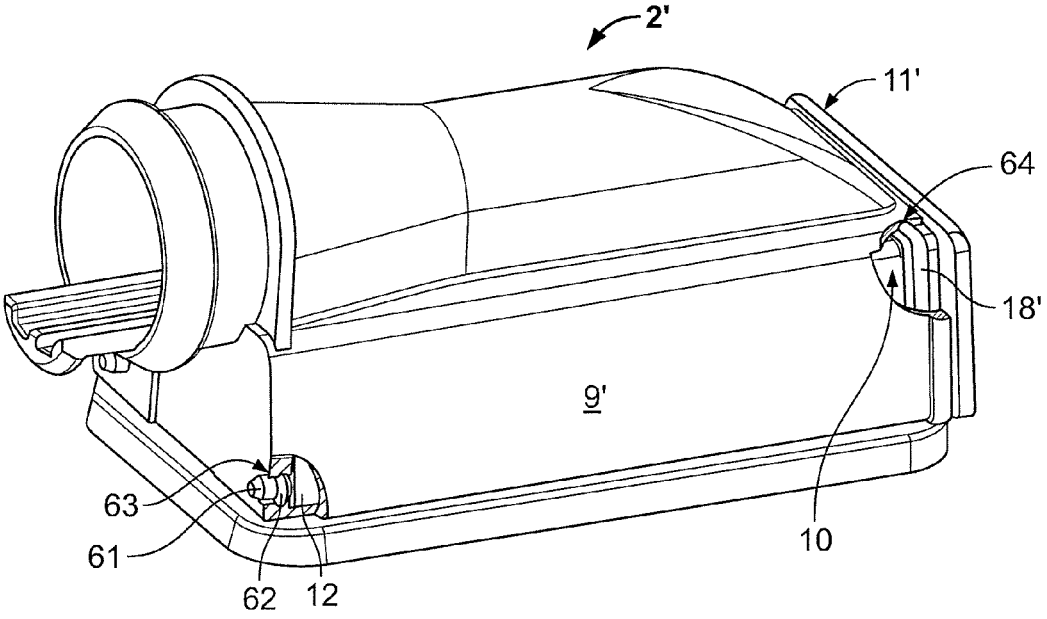

FIG. 10 shows a schematic perspective view of a further embodiment of a protective housing and a locking device of a plug element according to the invention prior to assembly; and FIG. 11 shows a perspective view of the protective housing shown in FIG. 10 and the locking device in the final plugged-together position.

First of all, a plug connector 1 according to the invention is described with reference to FIG. 1. The plug connector 1 comprises a plug element 2 and a mating plug element 3. The plug element 2 and the mating plug element 3 are arranged opposite one another either side of a hole 4 in a wall 5, wherein the plug element 2 is located on a first side 6 of the wall and the mating plug element 3 is located on a second side 7 of the wall.

The wall 5 is formed of three wall elements 5*a-c*, which are spaced from one another in a vertical direction Z of the plug connector 1. The wall elements 5*a-c* may for example be sheets of a motor vehicle body.

Figure 1:
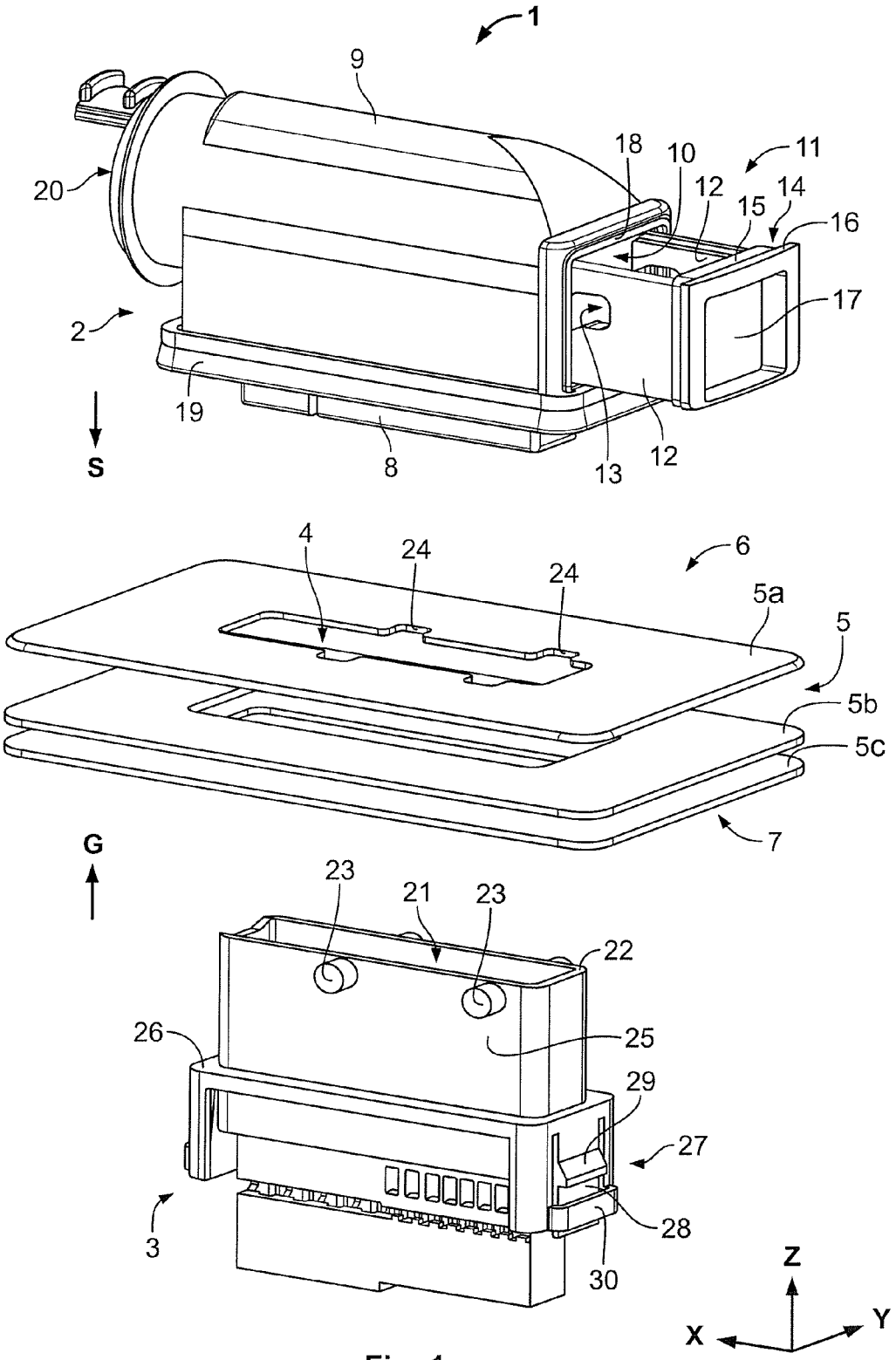
FIG. 1 is a schematic perspective view of a plug connector according to the invention with a plug and mating plug element arranged opposite one another either side of a hole in a wall portion prior to plugging together.

In the illustration shown in FIG. 1, the plug element 2 and the mating plug element 3 are in a position V prior to plugging together, in which they are ready to be brought together in a plug-in direction S of the plug element 2 or a mating plug-in direction G of the mating plug element 3 through the hole 4. To this end the plug element 2 has a plug-in portion 8, which takes the form of a plug and projects from the plug element 2 in the plug-in direction S.

Moreover, the plug element 2 comprises a protective housing 9. The protective housing 9 has an opening 10 in a longitudinal direction X of the plug connector 1 and extending transversely of the plug-in direction S and the vertical direction Z. A locking device 11 projects into the opening 10. Two spar-type locking members 12 extend from outside the protective housing 9 through the opening 10 into the inside (not yet shown here) of the protective housing 9. Each of the locking members 12 comprises a locking element 13 in the form of a guide of the gear gate type, which is provided as an aperture in the respective locking member. An actuating portion 14 of the locking device 11 comprises a peripheral shoulder 15, a collar 16 and an actuating surface 17.

In the embodiment shown in FIG. 1, a seal 18 is let into a peripheral area of the opening 10, which seal is intended to seal the protective housing 9 relative to the locking device 11, if the locking device 11 is introduced into the protective housing 9 as far as a locked position R (not yet shown here) through the opening 10, such that the seal 18 sealingly encloses the marginal shoulder 15 and rests sealingly against the collar 16.

A wall sealing element 19 surrounds a lower edge of the protective housing 9 pointing in the plug-in direction S in order to seal the protective housing 9 in a final plugged-together position E (not yet shown here) relative to the first side 6 of the wall 5. In addition, a cable duct 20 is formed on the protective housing 9, through which an electrical conductor or cable or cable loom may be introduced into the protective housing 9.

The mating plug element 3 has a plug receptacle 21, which is designed to receive the plug-in portion 8 of the plug element 2 in the final plugged-together position E. A plug collar 22 surrounds the plug receptacle 21. On an outer side of the plug collar 22 locking aids 23 are provided in the form of cams extending away from the plug collar 22 in a transverse direction Y of the plug connector 1. The locking aids 23 are designed to interact with the respective locking elements 13 of the locking device 11. To pass the locking aids 23 through the hole 4, locking aid recesses 24 are formed in the hole 4, which widen the hole 4 widthwise in the transverse direction Y.

In the vertical direction Z or contrary to the mating plug-in direction G a pass-through portion 25 is arranged below the locking aids 23 and designed, at least in the final plugged-together position E, to bridge a depth of the hole 4 extending in the mating plug-in direction G or a distance between the first side 6 and the second side 7 of the wall.

A wall stop 26 of the mating plug element 3 is arranged below the pass-through portion 25 contrary to the mating plug-in direction and points in the mating plug-in direction G. The wall stop 26 is designed to rest in the final plugged-together position E against a bearing surface (not shown), pointing in the direction of the second side 7 of the wall 5, of the wall element 5*a*, in order to support the mating plug element against the wall 5 in the mating plug-in direction G.

A wall catch 27 of the mating plug element 3 is arranged below the wall stop 26 contrary to the mating plug-in direction G. The wall catch 27 comprises a wall catch lug 28 with a wall latching nose 29 and a wall latching clip 30. The wall catch 27 is designed such that the wall latching nose 29 resiliently movable on the wall catch lug 28 latches behind the wall element 5*b* on passage of the mating plug element 3 through the hole 4 in the mating plug-in direction G. The wall latching clip 30 then lies against a side of the wall element 5*b* pointing towards the second side 7 of the wall 5, whereby the wall catch 27 locks the mating plug element 3 on the wall element 5*b* as early as in a semi-plugged-together position H. The wall latching clip 30 additionally protects the wall catch lug 28 from excessive deflection or bending, in that the wall latching clip 30 forms a stop for the wall catch lug 28.

Figure 2:
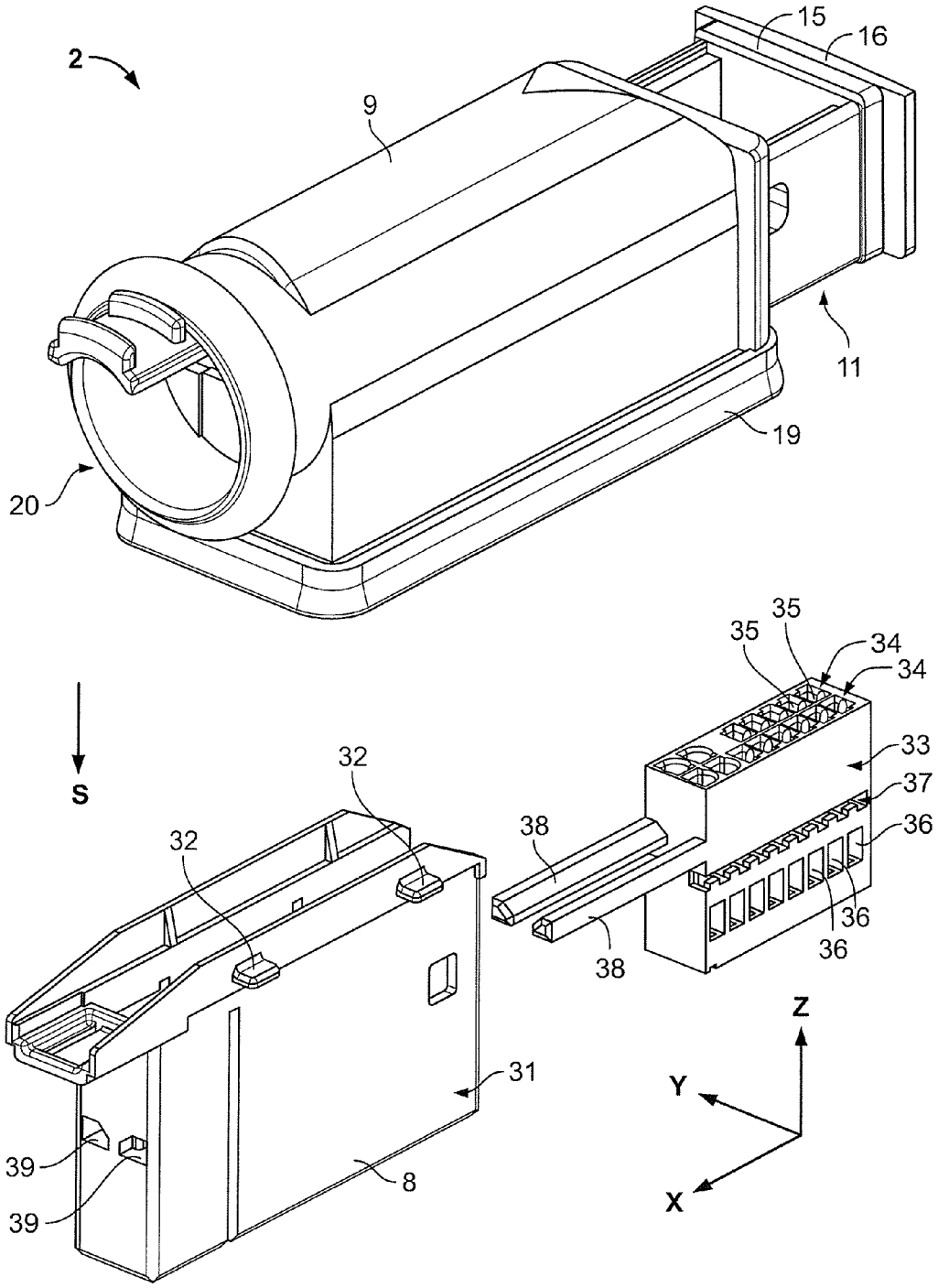
FIG. 2 is a schematic perspective view of a plug element according to the invention prior to assembly.

FIG. 2 shows the plug element 2 in a pre-assembly state O. Here a contact housing 31 of the plug element 2 has not yet been inserted into the protective housing 9. The plug-in portion 8 is formed on the contact housing 31. The contact housing 31 has fastening elements 32 in the form of lugs extending in the transverse direction Y away from the contact housing 31, which lugs are designed to arrest the contact housing 31 in the protective housing 9.

A contact module 33 has two adjacently arranged rows 34 of contact receptacles 35 in the form of socket contact receptacles for accommodating electrical socket contacts, said rows extending in the longitudinal direction X and being arranged adjacent one another in the transverse direction Y. One contact latching aid 36 per contact receptacle 35 extends in the form of a recess from the outside of the contact module 33 into the respective contact receptacle 35 and serves to latch a catch spring of a contact element not shown here to the contact module 33. A check groove 37 extending in the longitudinal direction X cuts through the contact receptacles 35 across the plug-in direction S and serves to receive a check profile (not shown) formed in the contact housing 31 on insertion of the contact module 33 into the contact housing 31, in order on the one hand to ensure correct seating of the contact elements in the contact receptacles and on the other hand to lock the contact elements in the respective contact receptacles 35. Check pins 38 extend in the longitudinal direction X away from the contact module 33 and serve to check correct seating of contact elements (not shown) arranged in the contact housing 31 on insertion of the contact module 33 into the contact housing 31. As soon as the contact module 33 has been fully inserted into the contact housing 31, the ends pointing in the side direction X of the check pins 38 project into check pin receptacles 39 in contact housing 31.

FIGS. 3*a-d* show the plug element 2 in the assembled state M, in which the contact module 33 has been inserted into the contact housing 31 and the contact housing 31 has been inserted into the protective housing 9. According to FIG. 3*a* without wall seal 19 the protective housing 9 has a width $b_U$, measured in the transverse direction Y, which may amount for example to 27.2 mm.

FIG. 3*b* shows that the plug-in portion 8 comprises a plurality of contact openings 39 for the introduction of electrical mating contact elements (not shown) accommodated in the mating plug element 3 in the form of pin contacts. The contact openings 39 point in the plug-in direction S. Fastening element recesses 40 in a plug-in base 41 of the protective housing 9 likewise pointing in the plug-in direction S are designed to accommodate the fastening elements 32 of the contact housing 31, or to guide the fastening elements 32 through the plug-in base 41 and arrest them therebehind in the mating plug-in direction. A plug-in face 42 of the plug element 2 comprises the plug-in portion 8, the plug-in base 41 and is framed by a wall 43 of the protective housing 9, which forms a plug-in opening 44 pointing in the plug-in direction S to a mating plug receptacle 45 of the protective housing 9. The fastening element recesses 40 here constitute part of the mating plug receptacle 45, because they serve for insertion of the catch aids 23 into the inner chamber 46 or expand the mating plug receptacle 45 in the transverse direction Y.

FIG. 3*c* makes clear that the protective housing 9 including wall sealing element 19 has a length $l_U$, measured in the longitudinal direction X, which may amount to for example 60.8 mm, and a height $h_U$, measured in the vertical direction Z, which may amount for example to 32.6 mm.

FIG. 4 is a perspective view of the plug element 2 in the assembled state M, offering a view through the cable duct 20 into the inner chamber 46 of the protective housing 9. In the inner chamber 46 there is arranged the contact housing 31, whose plug-in portion projects out of the plug-in opening 44 from the plug element 2 in the plug-in direction S.

FIG. 5 shows the mating plug element 3 in a schematic perspective view. Like the plug element 2 the mating plug element 3 comprises a contact housing 31, which comprises a plurality of contact receptacles 35' with contact latching aids 36' and a check groove 37'.

FIG. 6 shows the plug connector 1 in a semi-plugged-together position H, in which the plug element 2 and mating plug element 3 are assembled such that the plug receptacle 21 has been inserted into the plug-in opening 44 and the locking aids 23 of the mating plug element are arranged in the fastening element recesses 40 parallel to the plug-in direction S and mating plug-in direction G in each case in alignment with an inlet 47 to the locking elements 13. The mating plug element 3 projects into a mating plug receptacle 48 of the plug element forming part of the inner chamber 46, which receptacle is formed in the mating plug-in direction G behind the plug-in opening 44 between the wall 43 of the protective housing 9 and the plug-in portion 8. A mating plug-in base 49 in the plug receptacle 21 of the mating plug element 3 is arranged opposite the plug-in portion 8. The locking device projects with its locking members 13 through the opening 10 in each case into locking member receptacles 50 open towards the mating plug receptacle 48 and forming part of the inner chamber 46. In each of the locking member receptacles 50 a locking guide 51 extending in the longitudinal direction X is formed.

Locking member catches 52 comprise latching lugs 53, which are resiliently movable in the vertical direction Z and comprise a retaining element 54 and a latching nose 55, which interact with a catch aid 56 in the form of a cam in the locking member receptacle 50. In an unlocked position T shown in FIG. 6 of the locking device 11, the retaining element 54 rests against the latching aid 56 contrary to an actuation direction B, extending parallel to the longitudinal direction X, of the locking device 11 and thus prevents the locking device 11 from being pulled out of the locking member receptacle 50 contrary to the actuation direction B. Consequently the locking device 11 is accommodated captively in the protective housing 9. At the same time, the latching nose 55 engages behind the catch aid 56 on the opposite side of the catch aid 56 to the retaining element 54 contrary to the actuation direction B, whereby the locking device 11 is arrested in the unlocked position T and can only be moved in the actuation direction B with a certain amount of force, which must exceed the spring force of the latching lug 53 in such a way that the latching nose 55 slides over the catch aid 56 in the actuation direction B. FIG. 6 additionally reveals that the mating plug element 3 is latched with its wall catch 27 on the wall 5, as described above with reference to FIG. 1.

FIG. 7 shows the plug connector 1 from the same perspective as FIG. 6. Unlike in the illustration in FIG. 6, in FIG. 7 the plug connector 1 is in the final plugged-together position E. In the final plugged-together position E the locking device 11 has moved from the unlocked position T into a locked position R. The latching lug 53 has been released by the retaining element 54. The locking aids 23 have been moved along the locking elements 13 in such a way, in the mating plug-in direction G, that they have been secured in a stop region 57 of the locking elements 13 against movements parallel to the plug-in direction S or mating plug-in direction G and contrary to the longitudinal direction X or actuation direction B. The fastening elements 32 on the contact housing 31 of the plug element 2 are seated in the inlets 47 of the locking elements 13 acting as latching means, such that they secure the locking device 11 against movements contrary to the actuation direction B.

In the final plugged-together position shown in FIG. 7 the wall sealing element 19 rests against the first side 6 of the wall and provides a seal between the wall 5 and the plug element 2. A locking stop 58 on the locking member 12 rests in the actuation direction B against the locking aid 56 on the plug element 2. The actuating portion 14 of the locking device 11 sits in the opening 10, such that a collar 59, against the inner circumference of which the sealing element 18 rests, encloses the collar 16 of the locking device 11. The sealing element 18 is thus compressed sealingly between the opening collar 59 and the collar 16 and the actuating portion 14 closes the opening 10, wherein it forms part of an external wall of the protective housing 9.

FIG. 8 shows the plug connector 1 in the final plugged-together position E. It is clear herefrom how the plug-in portion 8 projects into the plug receptacle 21, the plug-in portion 8 resting against the mating plug-in base 49. It is additionally revealed that a check element 60 of the contact housing 31 projects through the check groove 37 into the contact receptacles 35.

FIG. 9*a* shows the wall 5 in plan view. In the wall element 5*a*, without the locking aid recesses 24, the hole 4 has a width $b_1$, which may for example amount to 13 mm. With locking aid recesses 24 the hole 4 in the wall element 5*a* has a width $b_2$, which may for example amount to 20 mm. A length $l_1$ of the hole 4 in the wall element 5*a* may for example amount to 49 mm.

FIG. 9*b* shows that a distance $d_1$ measured in the vertical direction Z between wall element 5*b* and wall element 5*c* is smaller than a distance $d_2$ measured in the vertical direction Z between wall element 5*a* and wall element 5*b*, wherein the distance $d_1$ may amount for example to 3 mm and the distance $d_2$ may amount for example to 9 mm.

FIG. 9*c* shows the wall 5 from below. It is clear herefrom that a width measured in the transverse direction Y of the hole in the wall elements 5*b* and 5*c* may be equal to the width $b_2$. A length $l_2$ measured in the longitudinal direction X of the hole 4 in the wall element 5*a* may for example amount to 53 mm. A length $l_3$ of the hole 4 in the wall element 5*c* may for example amount to 57 mm.

FIG. 10 shows an alternative embodiment of the plug element 2' according to the invention. An alternative embodiment of the locking device 11' is provided with an alternative embodiment of sealing elements 18', which are fitted on the locking members 12 configured as spars.

On the locking devices 11' closing stoppers 61 are formed in the form of pegs extending in the actuation direction B away from the respective locking member 12, which pegs are provided circumferentially with a stopper sealing element 62. In the actuation direction B the closing stoppers are each aligned with a tool recess 63 in the wall 8 of the protective housing 9'.

FIG. 11 shows the plug element 2' with the locking device 11' in the locked position R. The sealing element 18' sits in the opening 10 of the protective housing 9', which has been partially cut away for greater clarity. The sealing element 18' sits in a sealing groove 64, which is formed on an inner circumference of the opening 10. The closing stopper 61 sits in the tool recess 63 and closes it, wherein the stopper sealing element 62 provides a seal between the tool recess 63 and the closing stopper 61. For the sake of greater clarity, the tool opening 63 has been partially cut away.

Modifications of the above-described embodiments are possible within the concept of the invention. For instance, the contours of the plug connector 1, the plug elements 2, 2', the mating plug element 3 and the hole 4 may be conformed to particular requirements. The wall 5 may be formed of any desired number of wall elements 5*a-c* corresponding to the particular requirements. The plug-in portion 8, the wall sealing element 19, the plug receptacle 21, the plug collar 22, the wall stop 26, the wall catch 27 and the pass-through portion 25 may be matched to one another in accordance with the particular requirements.

It is advantageous, but not absolutely essential, for the locking device 11, 11' to take the form of a slider. This however simplifies closure of the hole 10 with the assistance of the locking device 11, 11', whose peripheral shoulder 15 may simply be pushed into the hole, such that the sealing element 18 engages sealingly around it, while the collar 16 may additionally rest against the sealing element 18 and protect it from mechanical intervention.

The fastening elements 32 may be configured in accordance with the particular requirements, although it is advantageous to configure them as in the present case as lugs, which may simply be inserted contrary to the plug-in direction S into the protective housing 9 and then secured against movements in the plug-in direction S by displacement of the contact housing 31 in the actuation direction B or in the longitudinal direction X.

The contact module 31 may be provided with a number of contact receptacles 34 corresponding to the particular requirements and be fitted as desired with a contact module 33. The contact receptacles 34, 34' may be populated as desired with socket or pin contacts and provided in accordance with the particular requirements with contact receptacles 34, 34', contact latching aids 36, 36' and check groove 37, 37'.

The fastening element recesses 40 may be matched to a particular configuration of the fastening elements 32. It is particularly advantageous for the fastening element recesses 40 to fulfil a dual function for latching the locking device 11, 11' in the locked position R.

Moreover, the plug-in base 41, the plug-in face 42, the wall of the protective housing 43, the plug-in opening 44 and the mating plug receptacle 45 may be formed in accordance with the particular requirements. The inner chamber 46 may be subdivided in accordance with the particular requirements into a mating plug receptacle 48 and a locking member receptacle 50. Such subdivision is not absolutely essential, however. To lock the plug connector, the mating plug receptacle 45 should intersect with the locking member receptacle 50 at least insofar as, or they should be joined together in such a way that, the locking device 11, 11' and the locking aids 23 may overlap and engage with one another in a projection in the plug-in direction S or mating plug-in direction G.

The locking member receptacles 50 and locking guides 51 may be configured, in accordance with the particular requirements, in such a way in a plane defined by the actuation direction B and plug-in direction S that, on actuation of the locking device 11, 11', they draw the plug element 2, 2' and mating plug element 3 together into the final plugged-together position E, at the latest once the locked position R is reached. Thus the locked position R may advantageously be reached at the same time as the final plugged-together position E is reached.

It is additionally advantageous, but not absolutely essential, to form the locking member catches 52, the catch aid 56, the stop region 57 and the locking stop 58 such that the locking device 11, 11' is latched in the unlocked position T and held captively in the protective housing 9, 9'.

Finally, it is advantageous, but not absolutely essential, to close a possible tool recess 63 by means of the locking device 11, 11', although this simplifies handling of the plug connector 1 and ensures that all the openings or recesses in the plug connector are closed in a sealed manner once the locked position R is reached.

The invention claimed is:

1. A plug element of an electrical plug connector for a sealed electrical plug-and-socket connection extending through a hole in a wall, having a protective housing, which comprises an inner chamber defined by outer walls of the protective housing, which forms a mating plug receptacle for a mating plug element complementary to the plug element, one of the outer walls of the protective housing having openings extending therethrough and along the outer walls, the plug element further comprising a locking device having elongate locking members slidably received in the openings and being actuable from outside the protective housing and moved from an unlocked position into a locked position, the locking device extending at least in the locked position into the inner chamber and overlapping the mating plug element, and having at least one sealing element at an intersection of the locking device and the one of the outer walls of the protective housing at least in the locked position of the locking device, the sealing element sealing the mating plug receptacle relative to an external environment of the plug connector, wherein the at least one sealing element is arranged sealingly adjacent to the openings when in the locked position and the sealing element not extending into the inner chamber and wherein the locking device is latched in each of the unlocked position and the locked position.

2. The plug element according to claim 1, wherein at least in the locked position the at least one sealing element is arranged in a region of the openings.

3. The plug element according to claim 1, wherein the at least one sealing element rests at least in the locked position around the circumference of a peripheral portion of the openings.

4. The plug element according to claim 1, wherein at least in the locked position an actuating portion of the locking device is arranged so as to be accessible from outside the protective housing.

5. The plug element according to claim 4, wherein the actuating portion closes the openings.

6. The plug element according to claim 1, wherein the at least one sealing element and a wall sealing element for sealing the plug connector relative to the wall and intended for arrangement between the protective housing and the wall are formed in one piece.

7. The plug element according to claim 1, wherein the at least one sealing element is formed at least in part from resilient material injection moulded onto the protective housing.

8. The plug element according to claim 1, wherein the at least one sealing element is formed at least in places from resilient material injection moulded onto the locking device.

9. The plug element according to claim 8, wherein the elongate locking members are defined as spars and the sealing element at least in places circumferentially encloses the spars of the locking device projecting through the openings.

10. The plug element according to claim 1, wherein at least one closing stopper is formed on the locking device, which closing stopper projects at least in the locked position through a tool recess in a wall of the protective housing, a stopper sealing element being arranged between the closing stopper and the tool recess.

11. The plug element according to claim 10, wherein the protective housing comprises at least one opening to the inner chamber and the tool recess is aligned with the opening.

12. The plug element according to claim 10, wherein the closing stopper is configured as a peg around the circumference of which the at least one stopper sealing element is injection moulded.

13. The electrical plug connector for an electrical plug-and-socket connection extending through a hole in a wall, having a plug element and a mating plug element, wherein the plug element is configured according to claim 1.

14. The electrical plug connector according to claim 13, wherein the plug connector comprises at least two rows of contact element receptacles, a pass-through portion of the mating plug connector arranged through the hole in the final plugged-together position having a width measured across the at least two rows of at most 13 mm.

15. The electrical plug connector according to claim 1, wherein the openings extend though a front wall of the protective housing, and the openings extend only through the front wall.

* * * * *